US010428470B2

(12) United States Patent
Smith et al.

(10) Patent No.: US 10,428,470 B2
(45) Date of Patent: Oct. 1, 2019

(54) PORTABLE ASPHALT HEATER APPARATUS AND METHOD

(71) Applicant: THE CITY OF CALGARY, Calgary (CA)

(72) Inventors: Adam Thornton Smith, Calgary (CA); Lucas Brent Groening, Calgary (CA); Majid Asefi, Calgary (CA)

(73) Assignee: The City of Calgary, Calgary, Alberta (CA)

( * ) Notice: Subject to any disclaimer, the term of this patent is extended or adjusted under 35 U.S.C. 154(b) by 0 days.

(21) Appl. No.: 16/046,086

(22) Filed: Jul. 26, 2018

(65) Prior Publication Data

US 2019/0032288 A1 Jan. 31, 2019

Related U.S. Application Data

(60) Provisional application No. 62/538,292, filed on Jul. 28, 2019.

(30) Foreign Application Priority Data

Jul. 28, 2017 (CA) ..... 2974753

(51) Int. Cl.
*E01C 19/08* (2006.01)
*E01C 19/46* (2006.01)
(Continued)

(52) U.S. Cl.
CPC ..... *E01C 19/08* (2013.01); *B65D 88/744* (2013.01); *E01C 19/463* (2013.01); *E01C 23/06* (2013.01); *E01C 23/065* (2013.01); *E01H 5/102* (2013.01)

(58) Field of Classification Search
CPC ..... E01C 19/08
(Continued)

(56) References Cited

U.S. PATENT DOCUMENTS 1,340,131 A * 5/1920 Andresen ..... E01C 19/10 404/111
1,376,852 A * 5/1921 Andresen ..... E01C 19/10 126/271.2 A (Continued)

FOREIGN PATENT DOCUMENTS

| | | |
|---|---|---|
| CA | 2425830 | 5/2002 |
| CA | 2582154 | 4/2006 |
| CA | 2771492 | 3/2013 |

OTHER PUBLICATIONS

"SSPH Hot Boxes Slip In Style", having a copyright date of 2015, sourced from http://steppmfg.com/ssph-hot-boxes-slip-in-style/.

(Continued)

*Primary Examiner* — Gary S Hartmann
(74) *Attorney, Agent, or Firm* — Antony C. Edwards

(57) ABSTRACT

A portable asphalt heater and method for heating asphalt includes an asphalt hopper having a floor, first and second side walls and front and rear end walls. The side walls taper inwardly to define a substantially inverted-V geometry of the hopper. A heating manifold including a heating chamber is adjacent to and positioned beneath the floor, the heating manifold adapted to be in fluid communication with a heater assembly and to direct a heated gas emitted from the heater assembly through the heating chamber and heating manifold. A plurality of chimneys is in fluid communication with, and extends from, the heating chamber and along the first and second side walls, wherein the volume of asphalt, when in the asphalt hopper, is heated through contact with the asphalt hopper.

25 Claims, 14 Drawing Sheets

(51) Int. Cl.
*B65D 88/74* (2006.01)
*E01C 23/06* (2006.01)
*E01H 5/10* (2006.01)

(58) Field of Classification Search
USPC ..... 404/79, 95
See application file for complete search history.

(56) References Cited

U.S. PATENT DOCUMENTS 1,546,185 A * 7/1925 Andresen ..... E01C 19/10 404/111
1,613,736 A * 1/1927 Andresen ..... E01C 19/10 34/170
3,386,435 A 6/1968 Heller
3,577,976 A 5/1971 Heller
3,625,489 A * 12/1971 Weaver ..... E01C 23/06 366/24
3,804,079 A * 4/1974 Schrader ..... C10C 3/12 126/343.5 A
4,418,682 A 12/1983 Heller
4,423,980 A 1/1984 Warnock
4,445,848 A * 5/1984 Heller ..... C10C 3/007 126/343.5 A
4,695,186 A 9/1987 King
4,978,068 A * 12/1990 Eldridge ..... B60H 1/18 239/129
5,120,217 A 6/1992 O'Brien et al.
6,109,826 A * 8/2000 Mertes ..... E01C 19/45 392/472
8,465,225 B2 6/2013 Groulx et al.
2015/0259864 A1 9/2015 Roy
2016/0123586 A1 5/2016 Groulx et al.

OTHER PUBLICATIONS

"Thermo asphalt container", sourced from http://www.werner-weber.com/en/container/roll-on-off-container/thermo-asphalt-container.
"Truck-mount—Falcon Asphalt Repair equipment", sourced from http:/falconrme.com/product/truck-mounted/.
"Asphalt Truck Bodies", having a copyright date of 2014, sourced from http://eqtwin.ca/en/trucks_accessories/4-dump_bodies_4_seasons_asphalt_-mg/136-asphalt_truck_bodies.
"310 Series Asphalt Bucket", having a copyright date of 2008, sourced from http://www.elp.ca/bennes/benne-a-asphalte-353.
"Diesel Fired, Recycling and Heat Management", having a copyright date of 2013, sourced from http://www.hemiequipment.com/diesel/.

* cited by examiner

PORTABLE ASPHALT HEATER APPARATUS AND METHOD

CROSS REFERENCE TO RELATED APPLICATIONS

This application claims priority from U.S. Provisional Patent Application No. 62/538,292 and Canadian Patent Application No. 2,974,753, both filed on Jul. 28, 2017, both entitled "PORTABLE ASPHALT HEATER APPARATUS AND METHOD", entireties of which are incorporated herein by reference.

FIELD

The present disclosure relates to apparatus and methods for heating asphalt; more particularly, this disclosure relates to a portable asphalt heater for heating asphalt and methods for using the asphalt heater apparatus.

BACKGROUND

Portable asphalt heaters, also referred to as asphalt carriers, are typically used in the building or repair of roads or other paved surfaces. Asphalt is typically a mixture of aggregates and binder, which may be applied in a layer on top of a base so as to form the paved surface. Aggregates may include crushed rock, sand, gravel and other materials. To bind the aggregate into a cohesive mixture, a binder is used, for example, bitumen. When asphalt is cooled to ambient temperatures, it forms a hard surface for supporting a load.

In order to create a substantially level asphalt surface, it is necessary to heat the asphalt to specific temperatures to facilitate spreading of the asphalt over a surface so as to create a substantially uniform layer. For example, depending on the particular type of asphalt used, the asphalt may need to be heated to a range of approximately 200° F. to 250° F. (or 93° C. to 121° C.) so as to render it malleable enough for spreading. It is therefore often required to maintain the asphalt in a portable asphalt heater or carrier, which carrier may be driven to the location of the paving project. Because the load of asphalt which may need to be transported to a project site may be quite heavy, for example in the range of eight metric tonnes, and because such transportation may often be accomplished by means of a truck, such asphalt carriers may be designed with a sufficiently lowered centre of gravity so as to maintain stability of the asphalt carrier vehicle when it is travelling at normal road or highway speeds, even while carrying a full asphalt load.

Furthermore, it is desirable for such asphalt carriers to be as efficient as possible at heating the asphalt and maintaining the asphalt at a given temperature, so as to conserve the fuel required to heat the asphalt, thereby reducing both the cost and the environmental impact of paving projects. Typical asphalt heaters may be fueled by diesel, propane or gasoline, for example.

In prior art asphalt carriers and heaters, of which the applicant is aware, there have been several attempts to make such equipment more energy-efficient. For example, in U.S. Pat. No. 8,465,225 by inventors Groulx et al (the '225 patent), a portable asphalt recycling and heat management unit comprises a seamless, vacuum-formed one-piece combustion chamber that defines a fuel incubator disposed therein.

The unit further includes a heat accumulator operably coupled to the combustion chamber and a hopper assembly.

The apparatus in the '225 patent further includes a heat distribution system in communication with the heat accumulator and the hopper assembly to provide heat to the hopper assembly for recycling used asphalt or for maintaining a mixture of asphalt for use in asphalt repairs. The portable asphalt recycling unit of the '225 patent is designed to be mounted on a trailer, and has an overall asymmetric geometry.

In U.S. Pat. No. 4,695,186 by inventor King (the '186 patent), an asphalt handling apparatus includes a hopper portion with an elongated trough, having a generally V-shaped cross-section. A pair of bifold doors selectively cover the opening to the hopper. The hopper heating portion includes an enclosed heat transfer medium first chamber disposed immediately below the V-shaped trough section and in direct contact therewith. The first chamber includes sloping wing sections and a deeper central section communicating therewith. A U-shaped burner channel is disposed substantially horizontally within the central section with the gas burner along the first arm and an exhaust stack extending upwardly from a second arm. An elongated electrical heating element is disposed between the arms. The liquid tack material dispensing portion includes an elongated second chamber located alongside the central section of the hopper heating portion. The second chamber includes tubing therein communicating with the central section of the hopper heating portion. A valve mechanism communicates within an outlet of the second chamber. A cleaning fluid reservoir communicates with the valve mechanism. Disposed within the hopper portion is a screw conveyor for moving the asphalt through the hopper towards the exit of the hopper.

In U.S. Pat. No. 3,577,976 by inventor Heller (the '976 patent), a unit for storing and maintaining asphalt At an elevated temperature includes a storage compartment that is enveloped within the body of heated air flowing at a controlled rate and the outer wall bounding the passage for this convection flowing heated air is insulated against heat loss. The enveloping heated air results in a heat gradient around the heated asphalt, minimizing heat loss. The interior of the asphalt storage unit includes an inverted V-shaped structure extending from the floor of the storage compartment so as to distribute heat from heated air flowing underneath the inverted V-shaped structure, reducing the internal storage capacity of the asphalt storage unit.

In U.S. Pat. No. 5,120,217 by inventors O'Brien et al (the '217 patent), a unit for heating initially solid asphalt material to provide the asphalt in a condition suitable for application includes an inner enclosure defining a volume for containing the asphalt to be heated, an outer enclosure surrounding and spaced from the inner enclosure to define a space beneath the inner enclosure and passages for heated air flow around the walls of the inner enclosure, a screw disposed in an open top channel at the floor of the inner enclosure to move heated material, an opening in the inner enclosure floor in communication with the passage in the outer enclosure floor for delivery of heated asphaltic material moved by the screw to the unit's exterior, heating chambers projecting upwardly from the floor of the inner enclosure above the heating sources to provide regions through which hot air rises from the sources, and flues extending transversely from the upper portions of the heating chamber to the end walls of the inner enclosure for conducting the heated air from the heating chambers to the aforementioned passages. The inner enclosure for containing the asphalt includes an approximately V-shaped geometry.

SUMMARY

In one aspect of the present disclosure an improved asphalt heating apparatus is provided, whereby the geometry of the asphalt hopper is substantially an inverted-V, whereby the base of the hopper is wider than the upper opening of the hopper. In some embodiments of the present disclosure, side walls of the hopper extend outwardly from the widened base, so as to form an approximately basin-shaped hopper base, and then the side walls taper slightly inwardly towards each other, terminating at the upper opening of the hopper. Advantageously, the applicant has found that this geometry provides for an asphalt hopper having a lower centre of gravity as compared to other asphalt hoppers which are wider at the top and narrower at the bottom, thereby making the asphalt carrier disclosed herein more stable during transport at normal highway speeds, particularly when carrying heavy loads, for example in the range of eight metric tonnes of asphalt.

Furthermore, in another aspect of the present disclosure, a more efficient heat exchange system for heating the asphalt within the asphalt hopper is provided. Advantageously, according to one aspect of the present disclosure, a heating manifold may include a heating chamber beneath the floor of the asphalt hopper. The heating chamber of the manifold may be in communication with a plurality of heating ducts or chimneys which run alongside and adjacent to the side walls of the asphalt hopper, leading to an exhaust collector running along the top of the side walls of the asphalt hopper. In this manner, as the heated gases flow through the heating manifold system from under the hopper floor through the heating chamber, proceeding through the plurality of chimneys and the exhaust collector. The heated gases, for example flue gases emitted by a burner of the asphalt carrier, may thereby transfer a substantially even amount of heat to the floor and side walls of the asphalt hopper, thereby evenly heating the asphalt contained within the hopper. In the Applicant's experience, such a design minimizes heat loss and more efficiently heats the asphalt in the hopper, compared to previously known designs for asphalt heater units.

In some embodiments, the Applicant has found that asphalt heaters constructed in accordance with this present disclosure are capable of efficiently recycling volumes of used asphalt, without the need for agitation of the asphalt material within the hopper. Furthermore, the asphalt hopper design disclosed herein does not require any kind of a conveyancing system within the asphalt hopper, simply utilizing gravity to remove asphalt from the hopper through one or more doors located at the end wall of the hopper by tipping the hopper and using gravity to remove the heated asphalt, thereby maximizing the internal volume of the hopper for carrying more asphalt material as compared to other designs which utilize screws or other conveyancing means to move the heated asphalt out of the hopper.

In some embodiments of the present disclosure, a tank for providing tack material, such as tar, may also be integrated into the asphalt heater disclosed herein. In some embodiments, for example, the tar tank may be located adjacent to the asphalt hopper, and the tar tank may include its own heater assembly and heat exchange system which is in communication with the asphalt hopper heat exchange system. In some embodiments, the exhaust of the tar heater assembly, which is separate from the asphalt heater assembly, may be efficiently utilized by redirecting the exhaust of the tar heater assembly into the heat exchange system for the asphalt carrier, thereby maximizing the use of the heat energy generated by the separate tar tank heater assembly.

In one aspect of the present disclosure, a portable asphalt heater apparatus for heating a volume of asphalt is provided. The asphalt heater apparatus comprises an asphalt hopper having a floor, first and second side walls and front and rear end walls, the side walls and end walls extending upwardly from the floor and defining an upper opening into the hopper, the opening above the floor and having an opening area which is less than a surface area of the floor; at least one door selectively closing the opening; and a heating manifold including a heating chamber adjacent to and positioned beneath the floor, the heating manifold adapted to be in fluid communication with a heater assembly and adapted to direct a heated gas emitted from the heater assembly through the heating chamber and heating manifold, wherein the volume of asphalt when in the asphalt hopper is heated through contact with the asphalt hopper.

In another aspect of the present disclosure, a method for heating and recycling a volume of used asphalt using a portable asphalt heater is provided. The method comprises the steps of loading the volume of used asphalt into a hopper of the portable asphalt heater, the hopper having a floor, first and second side walls and front and rear end walls, the side walls and end walls extending upwardly from the floor and defining an upper opening into the hopper, the opening above the floor and having an opening area which is less than a surface area of the floor, the hopper further including at least one door for selectively closing the upper opening, the portable asphalt heater further including a heating manifold including a heating chamber adjacent to and positioned beneath the floor, the heating manifold in fluid communication with a heater assembly and adapted to direct a heated gas emitted from the heater assembly through the heating chamber and heating manifold; loading one or more recycling additives into the hopper; and setting the heater assembly of the portable asphalt heater to maintain the volume of used asphalt at a recycling temperature. In some embodiments, the method may further include the steps of removing the volume of used asphalt from the hopper after a selected time interval has lapsed and applying the volume of used asphalt to a surface. In other embodiments, the method may further include the steps of mounting the portable asphalt heater to a wheeled vehicle and transporting the portable asphalt heater to the surface.

DETAILED DESCRIPTION

Figure 1:
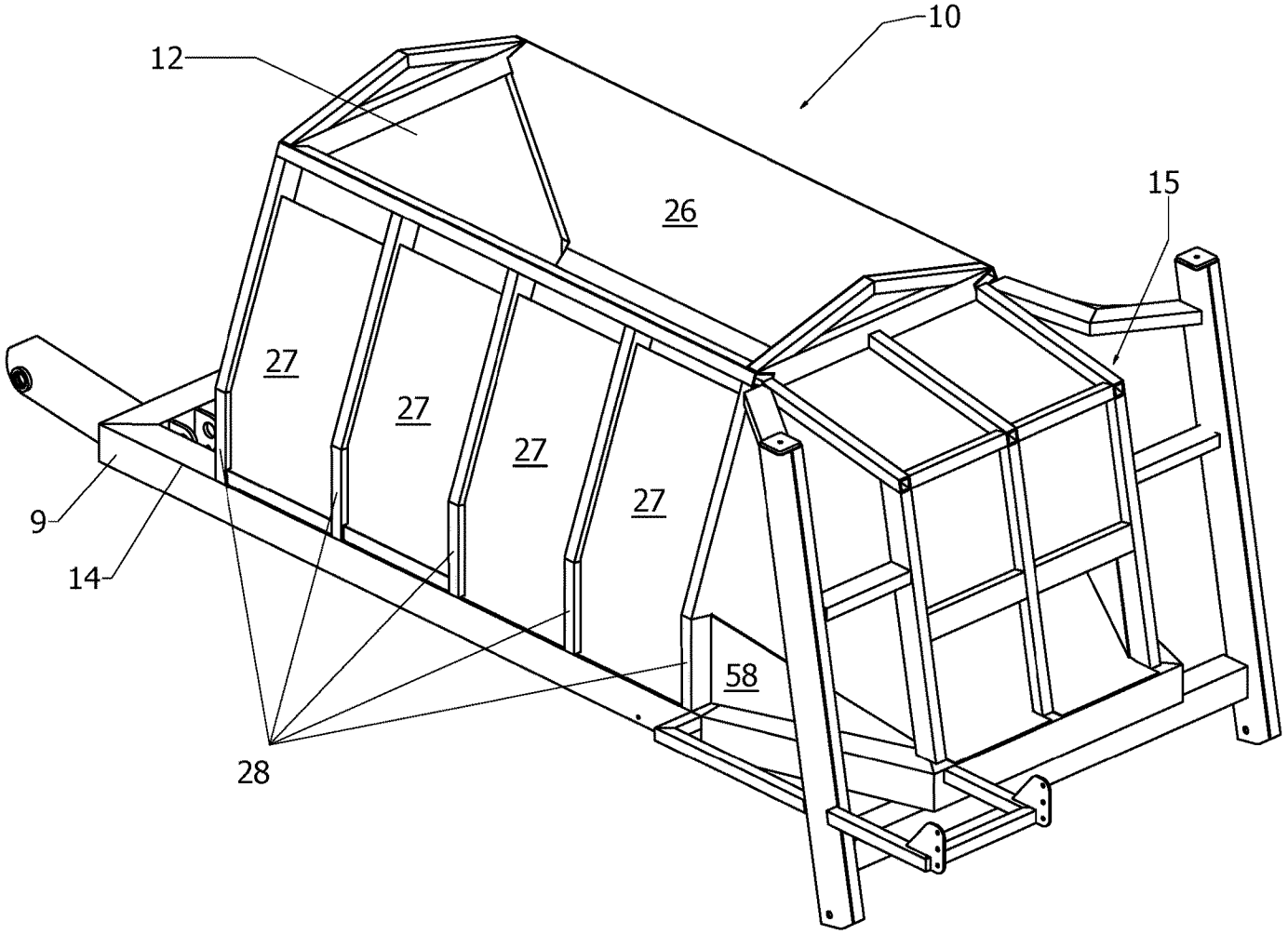
FIG. 1 is a perspective view of an asphalt carrier in accordance with an embodiment of the present disclosure.
Figure 2:
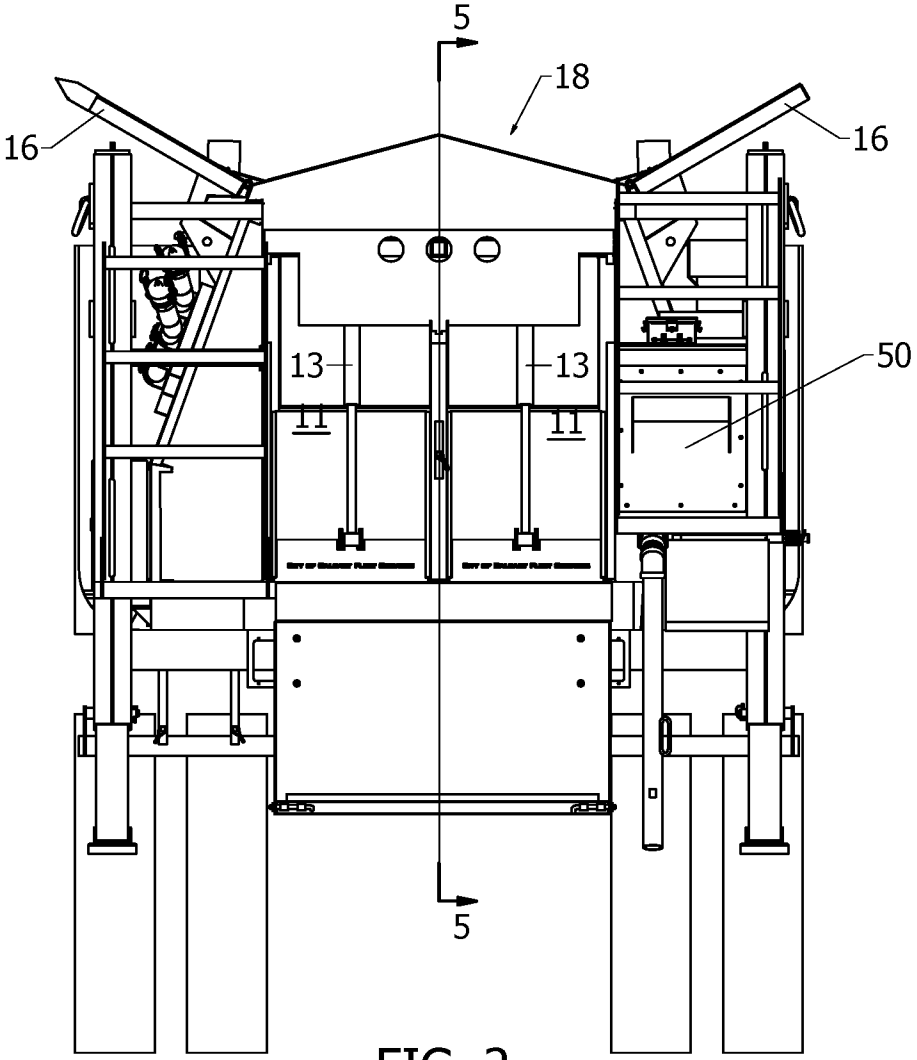
FIG. 2 is a rear elevation view of an asphalt carrier in accordance with another embodiment of the present disclosure, having an integrated tar tank.

The present disclosure provides for a portable asphalt carrier or heater (the terms carrier and heater are used interchangeably herein) which advantageously utilizes a geometry for the asphalt hopper which is approximately the shape of an inverted V, providing a wider base for the hopper than traditional asphalt hopper designs. This geometry advantageously provides for a lower centre of gravity for an asphalt heater, as compared to hoppers having a traditional V-shaped geometry.

The asphalt carrier disclosed herein, in one aspect of the present disclosure, is designed to be transported on a wheeled vehicle, such as a truck, at normal highway speeds, thereby requiring a lower centre of gravity for the asphalt hopper design so as to reduce the risk of tipping the vehicle when cornering, especially when the carrier is hauling a full load of asphalt. In some embodiments, the asphalt carrier may be designed to be releasably mounted to the box of a truck, such as a dump truck box. Advantageously, such a configuration may enable the use of a single truck box for multiple applications, such as mounting an asphalt carrier to the truck box for use in road repair during warmer weather, and a sanding/de-icing unit may be releasably mounted to the truck box for use in clearing ice from roads during cold weather. Although the asphalt carrier disclosed herein may typically be mounted (releasably or permanently) to a truck box, this is not intended to be limiting as the asphalt carrier may optionally be mounted to a trailer or other suitable means of transport.

A further advantage of the inverted V geometry of the asphalt hopper is that it may reduce the surface area of asphalt exposed to unheated surfaces or areas within the hopper, thereby making the overall heating of the asphalt carried within the hopper more efficient. In another aspect of the present disclosure, an efficient heat exchange system is provided whereby heated gases, such as flue gases emitted by the heater assembly of the asphalt heater where the heater assembly includes a burner, is directed through a heating chamber underneath the asphalt hopper, and then through evenly divided chimneys or heating ducts running through the inner side walls of the asphalt hopper, the heat from the flue gases or otherwise heated gases being efficiently transferred through the walls of the hopper to the asphalt material carried within the hopper cavity.

While most asphalt carriers known in the prior art include approximately V-shaped geometries for the asphalt hopper, so as to provide for a larger opening at the top of the hopper for receiving asphalt material, the hoppers disclosed herein, in one aspect of the present disclosure, include two doors each extending from the upper ends of the side walls of the hopper, which, when open, form a funnel-like structure for receiving the asphalt material, thereby providing for the advantages of the inverted-V geometry of the asphalt hopper described above, while not losing the advantage of efficiently transferring the asphalt into the hopper that the prior art asphalt hoppers provide with a V-shaped geometry.

In one aspect of the present disclosure, the heating manifold of the heat exchange system may include a heating chamber extending down the centre of the portable asphalt heater beneath the floor of the asphalt hopper. This arrangement provides for a symmetric heating path which directs the heated gas down the centre underneath the floor of the hopper, and then along either side of the centre heating chamber through peripheral chambers under the hopper floor, and then lastly up the side walls of the hopper where a pressure balancing baffle creates different flow rates within the wall chambers or wall portion of the manifold, creating a substantially even heat distribution throughout the asphalt hopper. The design of the skeletal structure of the asphalt hopper creates substantially equally divided chambers running up each of the hopper's side walls. The chimneys may each feed into an exhaust collector running along the upper edge of each sidewall, whereby the heated gases may exhaust out of one end of the exhaust collector.

In some embodiments, the exhaust collector may have a gradually widening cross-section, with the largest cross-section located at the exit of the exhaust collector, thereby increasing pressure at the point where the heated gases exhaust from the heating manifold of the asphalt heater apparatus. Advantageously, having a positive pressure at the exhaust point contributes to balancing the heat transfer throughout the heating manifold, and also compensates for the pressure drops that occur upstream at other points in the manifold.

Optionally, an integrally mounted heated tar tank may include a separate heater assembly, such as for example a burner. The heated gas produced by the tar tank heater assembly or burner may be exhausted under the floor of the asphalt hopper, thereby recycling the unused heat from the tar heater assembly by redirecting it through the asphalt heating manifold so as to heat the asphalt hopper, further adding to the efficiency of the overall system. The tar tank may further include its own set of thermocouples for monitoring the temperature of the tar held within the tank, the signals from the thermocouples being sent to a controller for the tar heater assembly so as to control the temperature of the volume of tar within the tank to maintain the tar at a desired temperature or within a desired temperature range. A damper separating the asphalt heating chamber from the tar burner chamber closes so as to avoid backfeeding heated gas into the tar tank combustion chamber when the tar tank burner assembly is not in use.

Referring now to FIGS. 1, 2 and 3A to 3C, asphalt carrier 10 includes an asphalt hopper 12 supported on a frame 14. A pair of hopper doors 16 (not shown in FIG. 1) are used to selectively close the opening 18 into the hopper 12. To remove heated asphalt A from the hopper 12, the rear doors 11, 11 may be raised by activating the hydraulic cylinders 13, 13, and the front portion 9 of the frame 14 may be raised relative to the rear portion 15 of the hopper 12, causing the asphalt A to flow out of the hopper 12 through the rear doors 11, 11 under the force of gravity.

Referring to FIGS. 3A to 3C, 4 and 7, in one embodiment of the present disclosure a cross-sectional view of the hopper 12 reveals that the geometry of the hopper 12 is substantially in the shape of an inverted V. In some embodiments of the present disclosure, the hopper 12 may include a floor 20, front and rear end walls 3, 5 extending vertically upwardly from floor 20 and a pair of side walls 22, 24. The side walls 22, 24 are themselves formed of an interior panel 26 and exterior panel 27 and a series of vertical ribs 28. As may be best seen in FIGS. 4-6, and as will be discussed further below, the structure of the ribs 28 sandwiched between the interior and exterior panels 26, 27 of side walls 22, 24 forms a plurality of chimneys 30. Heated gases Y emitted from the heater assembly 33 rise from the heating chamber 32 beneath the floor 20 of the hopper 12 and then through the plurality of chimneys 30, as illustrated for example in FIG. 4 by the plurality of arrows X denoting the path of the heated gases through chimneys 30. Insulation may be added to the exterior panel 27 and/or the end walls 3, 5 so as to facilitate heat retention. Furthermore, the interior panels 26 may be preferably constructed of efficient heat transfer materials which efficiently transfer the heat from the circulating heated gases X to the cavity 19 of hopper 12 and the volume of asphalt A contained therein.

After the heated gases X rise through the plurality of chimneys 30, they are collected at the upper end of the chimneys 30 in an exhaust collector 60 running along the top of each side wall 22, 24. Each collector 60 has a rear end 60*a*, a front end 60*b* and an exhaust portion 60*c*. The rear end 60*a* of each exhaust collector 60 have a width J and the front ends 60*b*, 60*b* each have a width K, whereby the width K may be greater than the width J. The heated gases X are exhausted out of the exhaust portion 60*c* of each collector 60. Thus, as heated gases X flow through the collector 60 from rear end 60*a* towards front end 60*b*, the increased volume of the collector 60 results in another pressure increase as the velocity of the heated gas X decreases, again contributing to the pressure balancing of the overall heat transfer system and compensating for pressure drops that occur at various points upstream in the heating manifold.

Figure 3A:
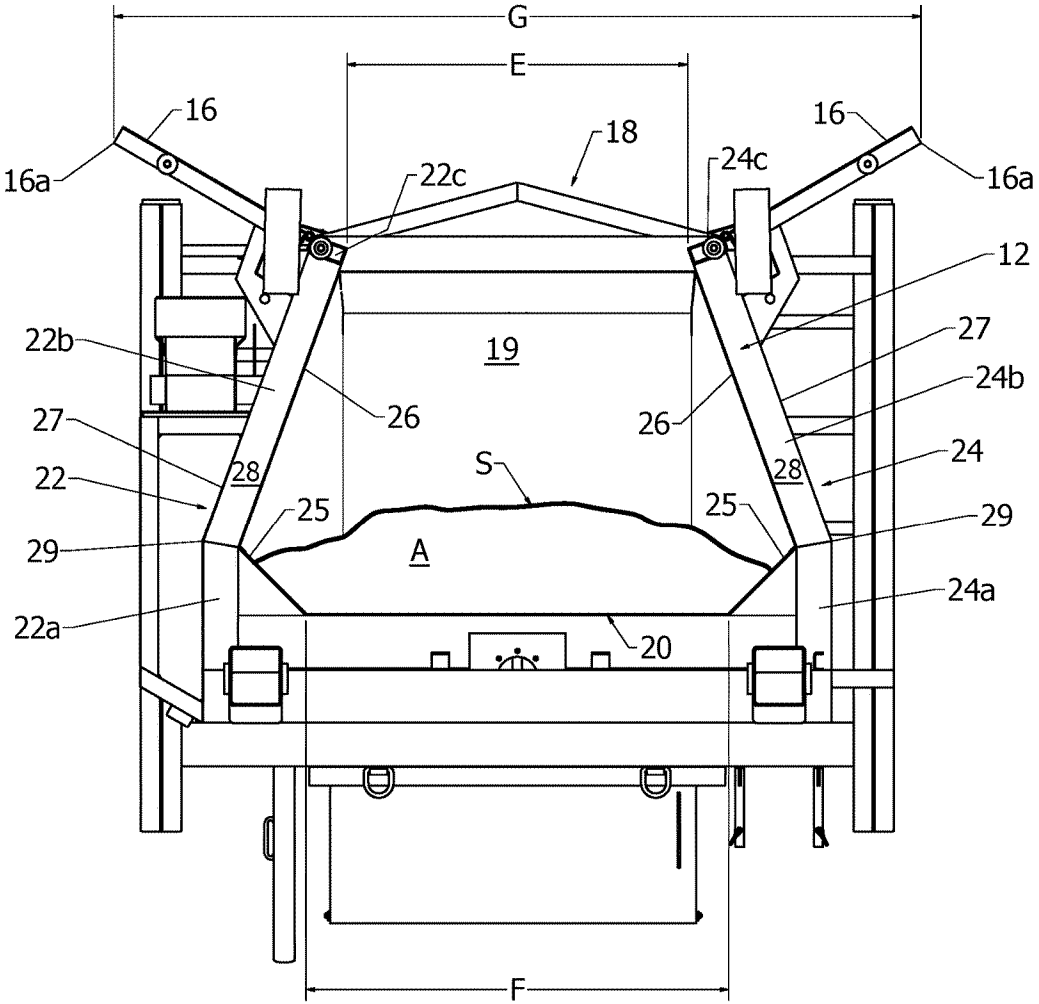
FIG. 3A is a cross-sectional view of the asphalt carrier of FIG. 5 taken along line 3A-3A, the asphalt carrier carrying a portion of a load of asphalt.
Figure 3B:
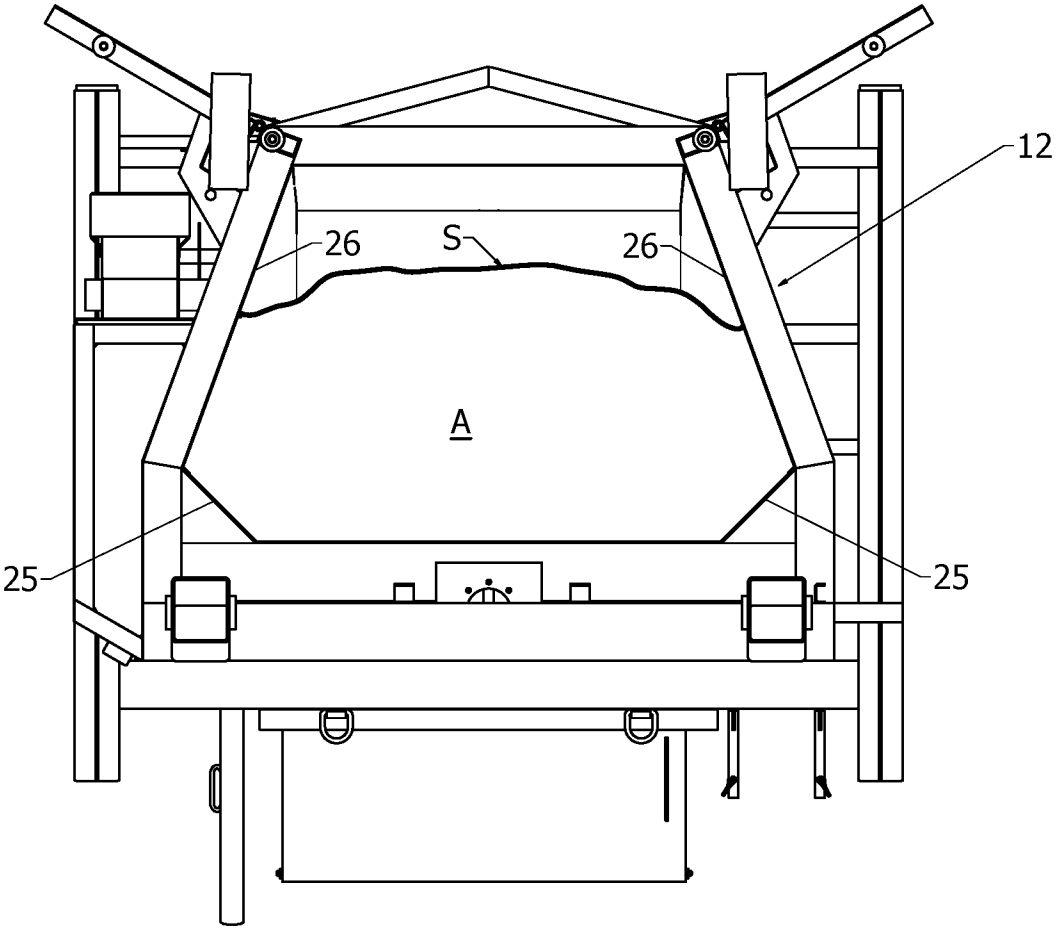
FIG. 3B is a cross-sectional view of the asphalt carrier FIG. 5 taken along line 3B-3B, the asphalt carrier carrying a half load of asphalt.
Figure 3C:
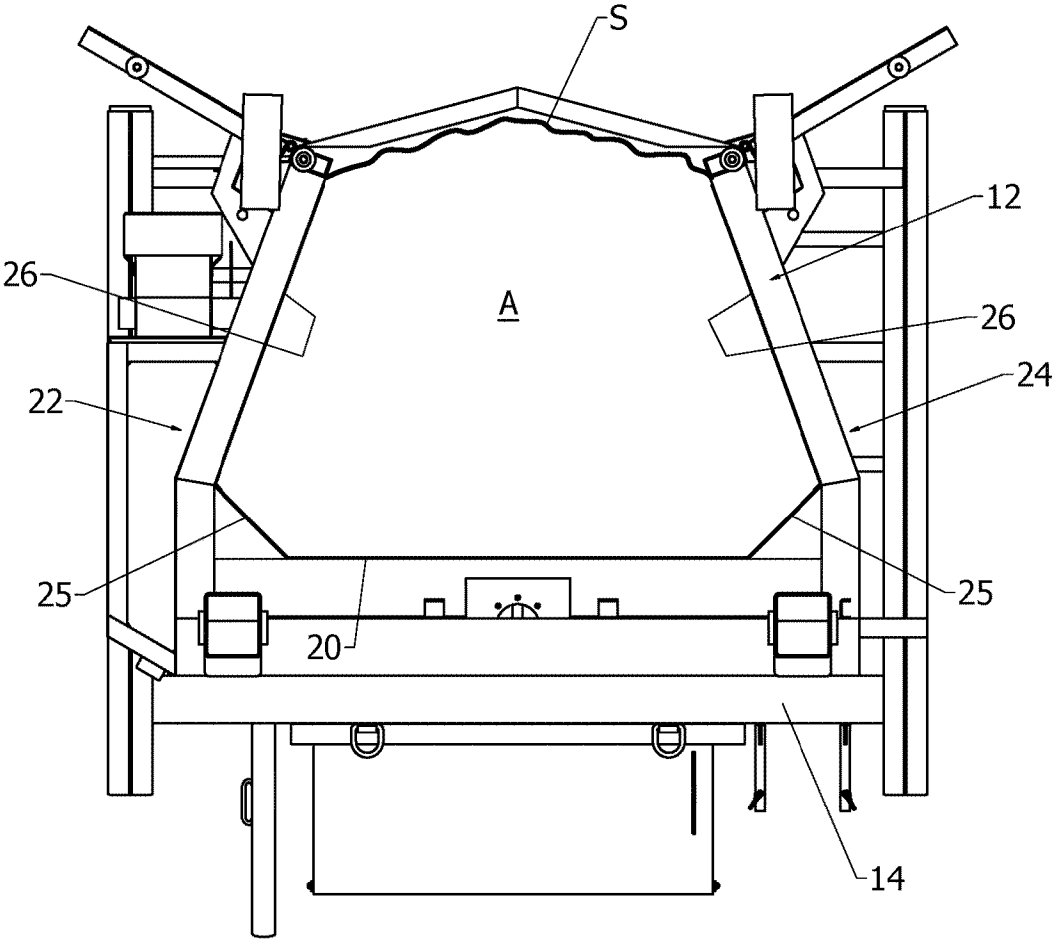
FIG. 3C is a cross-sectional view of the asphalt carrier of FIG. 5 taken along line 3C-3C, the asphalt carrier carrying a full load of asphalt.
Figure 4:
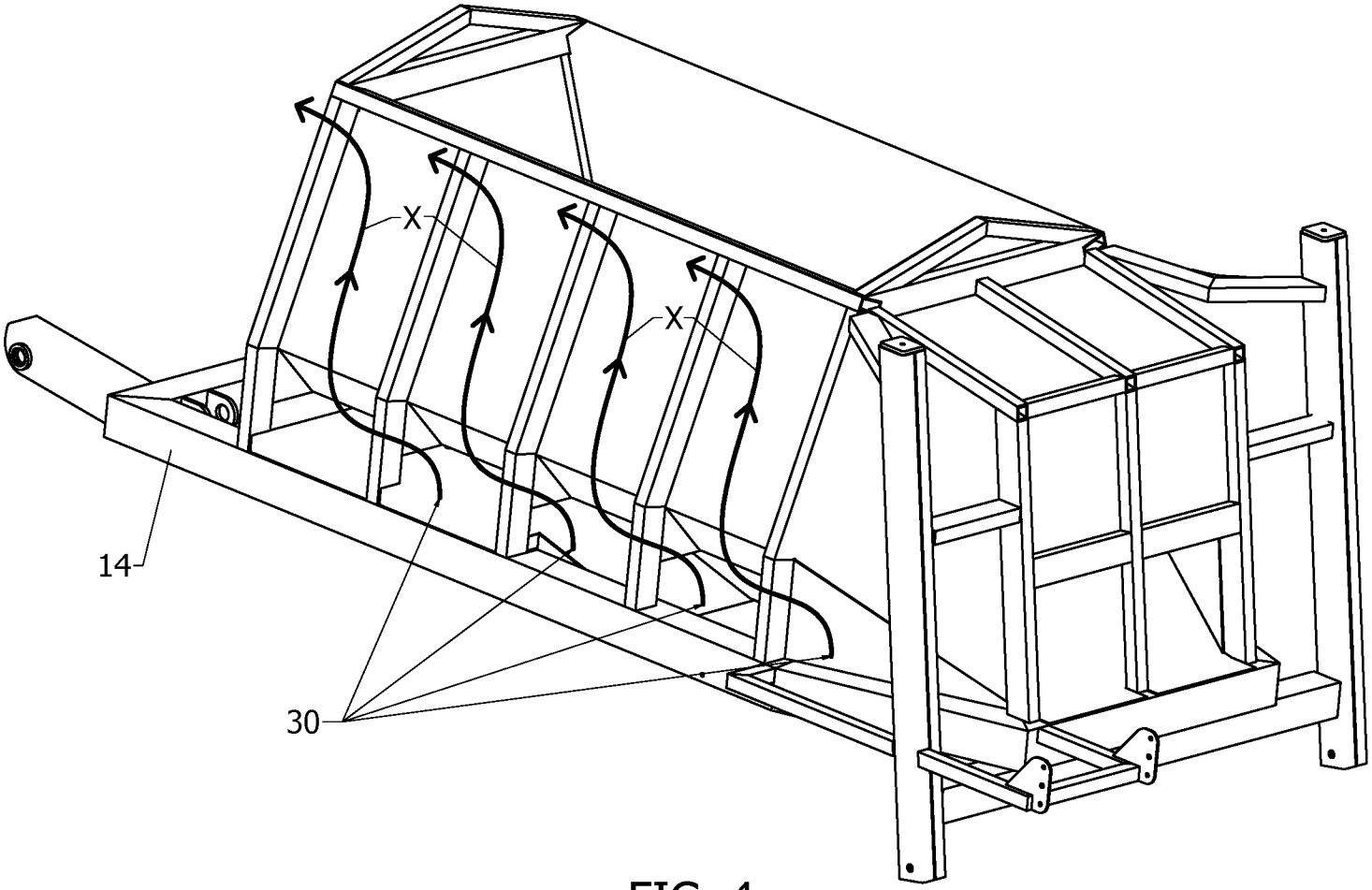
FIG. 4 is a partially cut away view of the asphalt carrier of FIG. 1, showing the pathways of the heated gas travelling through the chimneys.

In some embodiments of the present disclosure, the inverted V geometry of the hopper 12 may be accomplished by a first portion 22*a*, 24*a* of each side wall 22 and 24 rising substantially vertically from floor 20, and then second portions 22*b*, 24*b* of each side wall 22, 24 tapering inwardly towards each other and terminating at an upper edge 22*c*, 24*c* of the side walls 22, 24. The hopper doors 16, 16 may be pivotably mounted to the upper edges 22*c*, 24*c* of the side walls 22, 24. Optionally, a pair of interior ramps 25, 25 may each extend from the floor 20 of the hopper 12 towards a junction 29 between the first and second portions 22*a*, 22*b* of side wall 22 and between the first and second portions 24*a*, 24*b* of side wall 24, thereby facilitating movement of a volume of asphalt A out of the hopper 12. Advantageously, in asphalt hopper 12 having an inverted V geometry, whereby a width F of the floor 20 is greater than a width E of the opening 18 of the hopper 12, the centre of gravity of the asphalt hopper 12 when carrying a load of asphalt A will be lower compared to a traditional asphalt hopper having a V-shaped geometry whereby the width of the floor of the hopper is narrower than the opening of the hopper. As shown in FIG. 3A, when the hopper 12 is less than half-full, the volume of asphalt A is spread substantially across the floor 20 of hopper 12. In FIG. 3B, showing an approximately half-full hopper 12, much of the volume of asphalt A is contained within the lower half of the hopper 12. Even when the hopper 12 is carrying a full capacity load of asphalt A, as shown in FIG. 3C, due to the inverted the shape geometry of the hopper 12, more than half of the load is located in the lower half of the hopper 12, thereby lowering the center of gravity of the loaded asphalt hopper 12 and increasing the stability of the asphalt carrier 10 under load.

In addition to having a lowered centre of gravity, as compared to prior art designs of asphalt carriers, the inverted V geometry of the hopper 12 disclosed herein advantageously decreases the exposed surface S of the volume of asphalt A which is not in contact with any of the heated surfaces 20, 25 or 26 of the cavity 19, as compared to traditionally-shaped asphalt hoppers. For example, as shown in FIG. 3A, when the hopper is less than half full, much of the asphalt material is in contact with the floor 20. As shown in FIG. 3B, when the hopper 12 is at approximately half capacity, the exposed surface S of the volume of asphalt A is somewhat reduced compared to the exposed surface S of the asphalt A shown in FIG. 3A. In FIG. 3C, illustrating the hopper 12 at full capacity, the volume of asphalt A has an even further reduced exposed surface S as compared to the volumes of asphalt shown in FIGS. 3A and 3B, and furthermore, much of the volume of asphalt A is in direct contact with the heated surfaces, such as the floor, the ramps 25, 25 and substantially the entire interior panels 26, 26 of the side walls 22 and 24. In contrast, in a traditional asphalt hopper having a substantially V-shaped geometry, as the volume of asphalt material A increases, the exposed surface S of the volume of asphalt A would also increase.

In another aspect of the present disclosure, the placement of the hopper doors 16, 16, which may be pivotably mounted to the upper ends 22*c*, 24*c* of side walls 22 and 24, may advantageously provide for a funnel shape when the doors 16, 16 are in an open position, as shown for example in FIG. 3A. That is, when the doors 16, 16 are in an open position, a width G between the distal ends 16*a*, 16*a* of the doors 16 may be greater than the width E of opening 18 into the hopper, and in some embodiments greater than the width of the floor 20, thereby advantageously facilitating the receipt of asphalt material A into the cavity 19 of the hopper 12 through opening 18 when the doors 16, 16 are in an open position.

In another aspect of the present disclosure, the heat exchange system of the asphalt carrier will now be described with particular reference to FIGS. 4-7. In some embodiments the heat exchange system includes a heating chamber 32 located beneath the floor 20 of the asphalt hopper 12, where the heater assembly 33 is located, and the plurality of chimneys 30 which are each in fluid communication with the heating chamber 32 and which provide paths for heated gas to flow along the side walls 22, 24, thereby heating the interior panels 26 of the hopper 12. Shown in FIG. 7 in dotted outline, the heater assembly 33 may include a burner (not shown) which burns a fuel to provide a heated gas Y, the burner optionally attached to a burner tube 33*a*. The heater assembly 33 may include a burner which combusts an appropriate fuel, such as diesel, propane, gasoline, or any other suitable fuel for this application known to a person skilled in the art. Use of a burner tube 33*a* may reduce hot spots at the outlet of the heater assembly 33, so as to provide more balanced, even heat transfer throughout the floor 20, thereby reducing the overheating or coking of asphalt material A that may otherwise occur due to hot spots at the outlet of the heater assembly 33. The heater assembly 33 is not limited to including a burner, and may include any type of structure or heating device which is capable of emitting heated gases or heating the air or other gases flowing through the heating manifold of the heat exchange system as known to a person skilled in the art.

Figure 7:
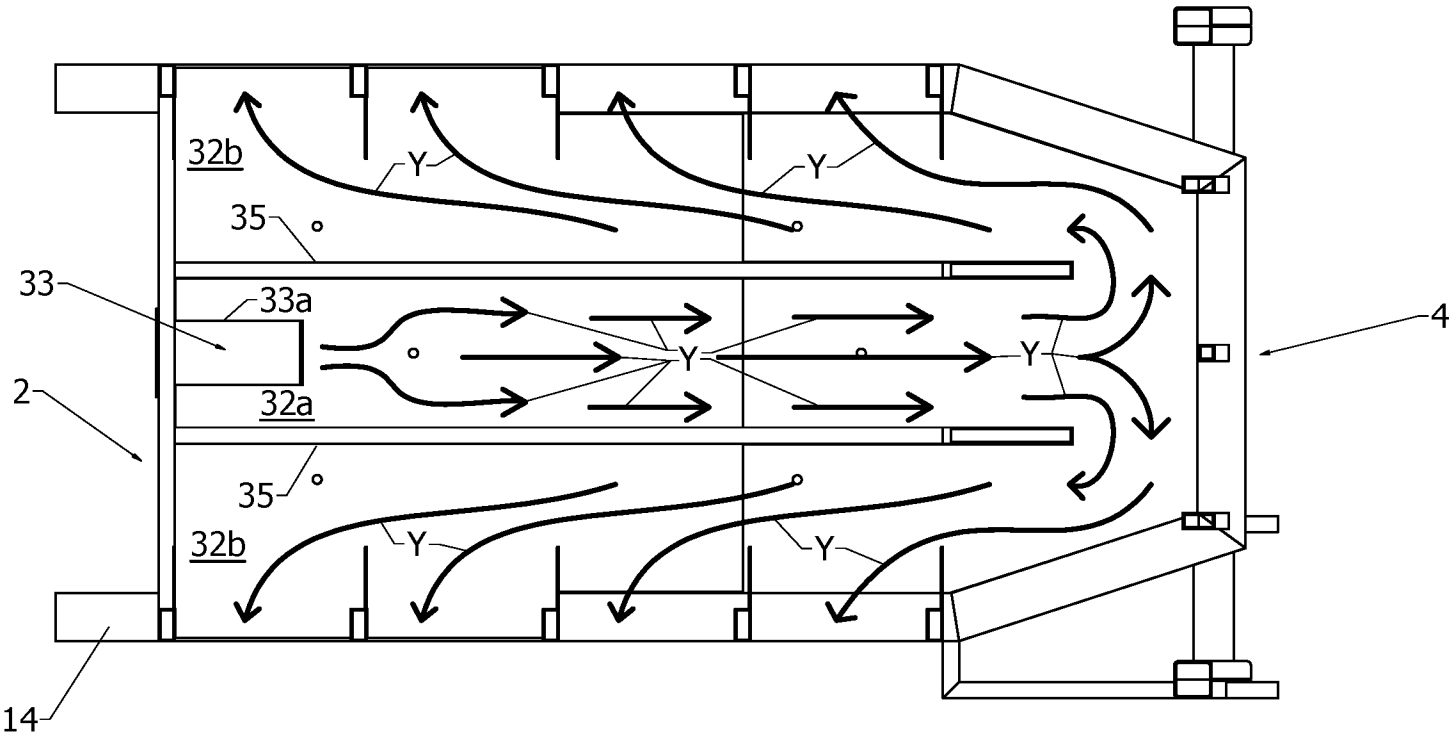
FIG. 7 is a top plan cross-sectional view of the asphalt carrier of FIG. 5, taken along line 7-7.

In some embodiments, dividing walls 35, 35 may divide the heating chamber 32 into a central chamber 32*a* and two peripheral chambers 32*b*, 32*b*. Upon firing the heater assembly 33, heated gases firstly travels through the central chamber 32*a*, and then upon encountering a rear wall 5 of hopper 12 the heated gases flow in the opposite direction along each of the peripheral chambers 32*b*, 32*b*, which peripheral chambers 32*b* are in fluid communication with the plurality of chimneys 30 running up along each of the side walls 22, 24, as shown in FIG. 7 (indicated by arrows Y). In this design, the applicant has found that the pressure is relatively evenly balanced between the two peripheral chambers 32*b*, 32*b* and amongst the plurality of chimneys 30 vertically alongside the side walls 22, 24. So as to promote the balancing of the heat across the floor 20, in some embodiments a central portion 20*a* of the floor 20 may be located directly above the central chamber 32*a*, and peripheral portions 20*b*, 20*b* of the floor 20 may be located directly above of the peripheral chambers 32*b*, 32*b*, whereby the thickness of the material used for the central portion of the floor 20*a* may be thicker than the peripheral portions of the floor 20*b*, 20*b*, so as to account for the higher temperatures of the heated gases flowing through central chamber 32*a*, which is immediately adjacent to the heater assembly 33 emitting the heated gases.

Figure 5:
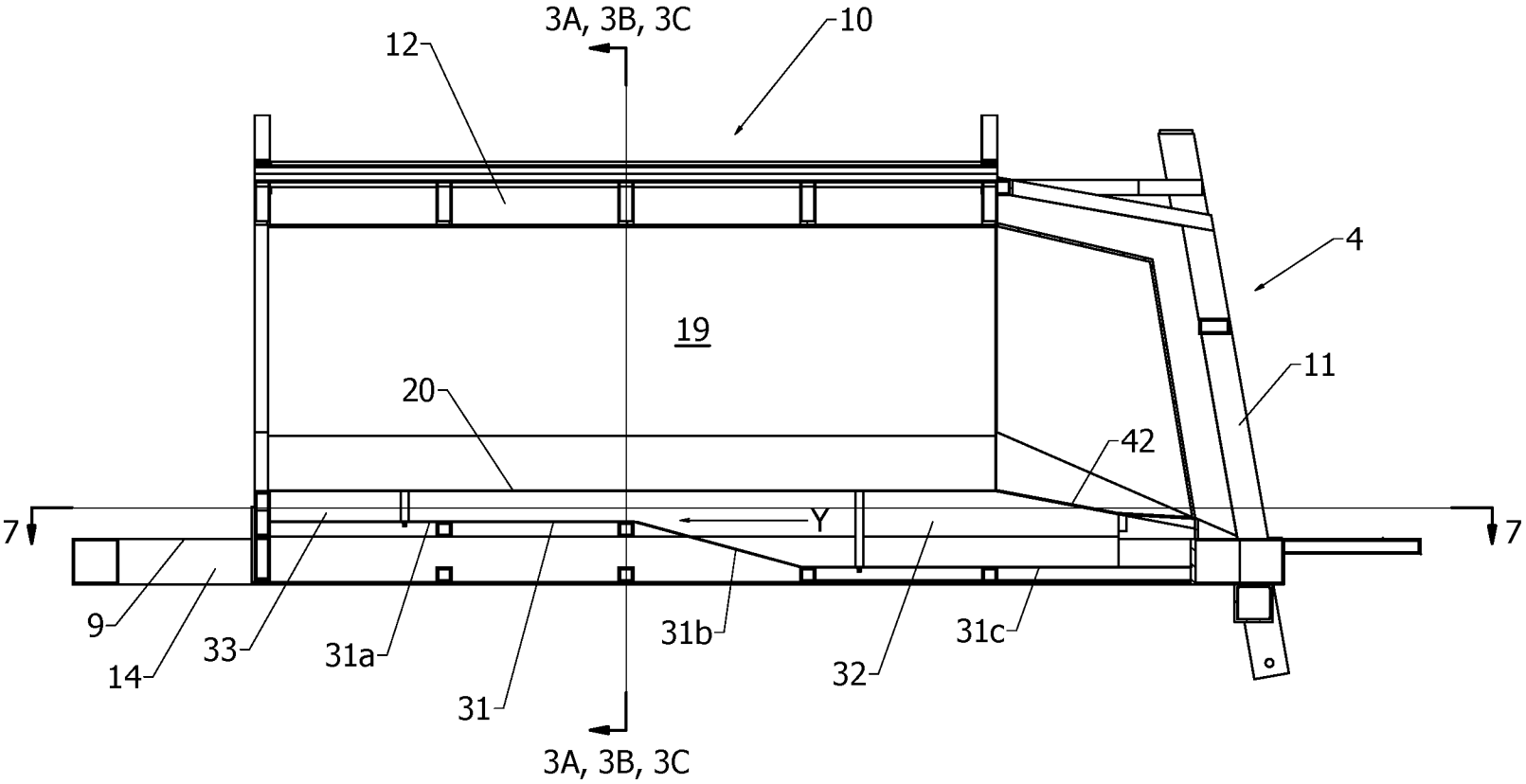
FIG. 5 is a cross-sectional view of the asphalt carrier of FIG. 2, taken along line 5-5.
Figure 6:
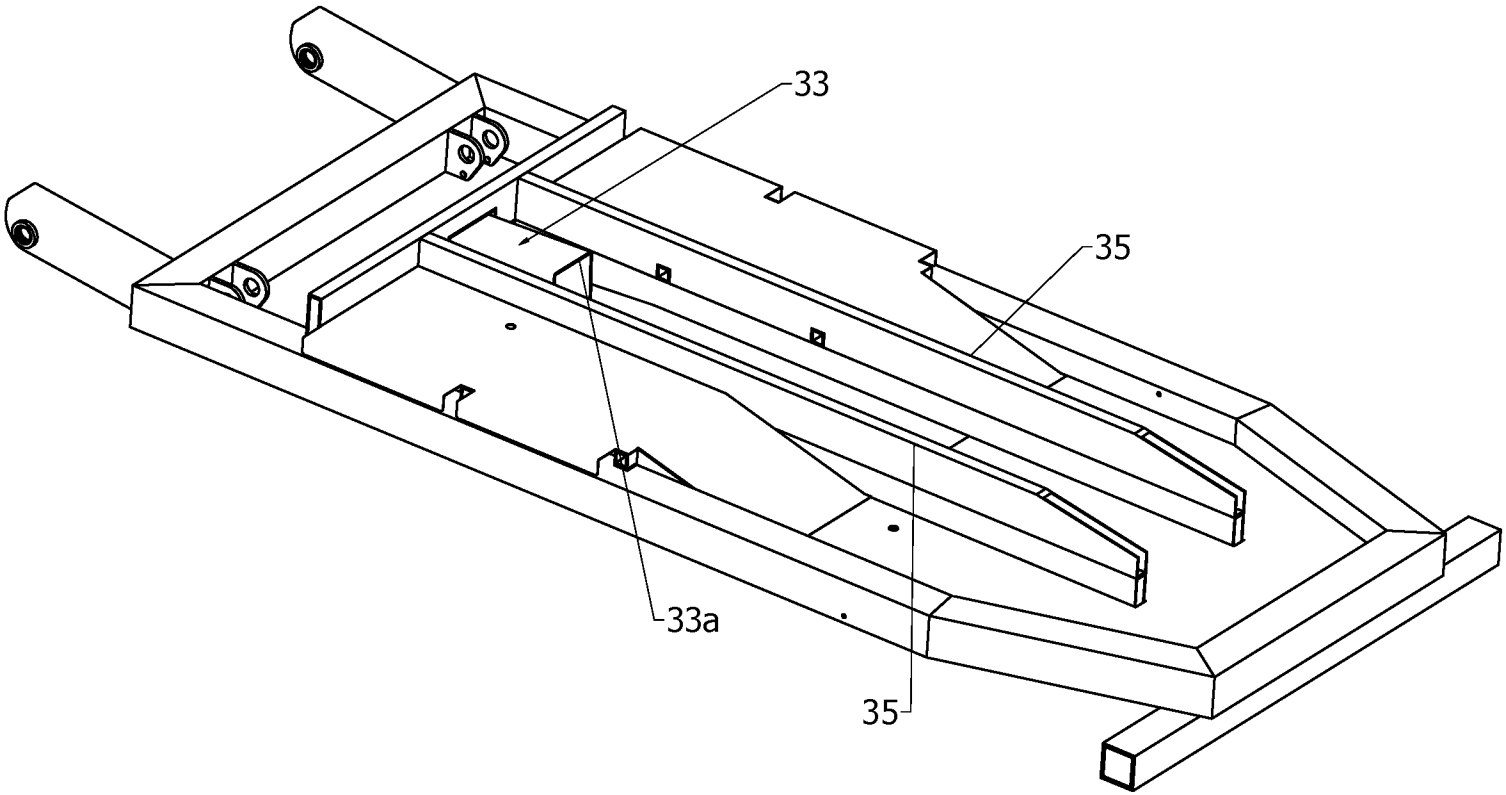
FIG. 6 shows the heating chamber structure of the asphalt carrier shown in FIG. 1.

The vertical dimensions of the heating chamber 32, and the manner in which the vertical dimensions change from the front end 2 of the carrier 10 to the rear end 4 of the carrier where the doors 11, 11 are located, may be best viewed in FIGS. 5 and 7. Proximate the rear end 4 of the carrier 10, the floor 20 transitions to a sloped ramp 42, which slopes downwardly towards the doors 11, 11 thereby facilitating the removal of asphalt material A from the hopper 12 when the frame 14 of the carrier is lifted at the front end 9. The heating chamber 32 is bounded at the upper end by the floor 20 and the ramp 42, and is bounded at the lower end by a chamber floor 31. As seen in FIG. 5, heating chamber floor 31 includes an upper portion 31*a*, a ramp portion 31*b*, and a lower portion 31*c*. When the heater assembly 33 is fired, the heated gas Y initially flows through the narrower central heating chamber 32*a*, best viewed in FIG. 7, and then proceeds to a wider heating chamber passage which is bounded by the floor 20, chamber floor 31 and ramp 42, thereby creating an increase in pressure of the flowing heated gas Y. Then, as the heated gas Y flows through the peripheral heating chambers 32*b*, 32*b* passing from the wider passage at the rear end 4 towards the narrower passage at the front end 2, a pressure drop is caused by the decrease in heating chamber volume. This pressure drop, in the applicant's experience, further assists with balancing the heat across the central and peripheral chambers 32*a*, 32*b* and the plurality of chimneys 30.

Figure 8:
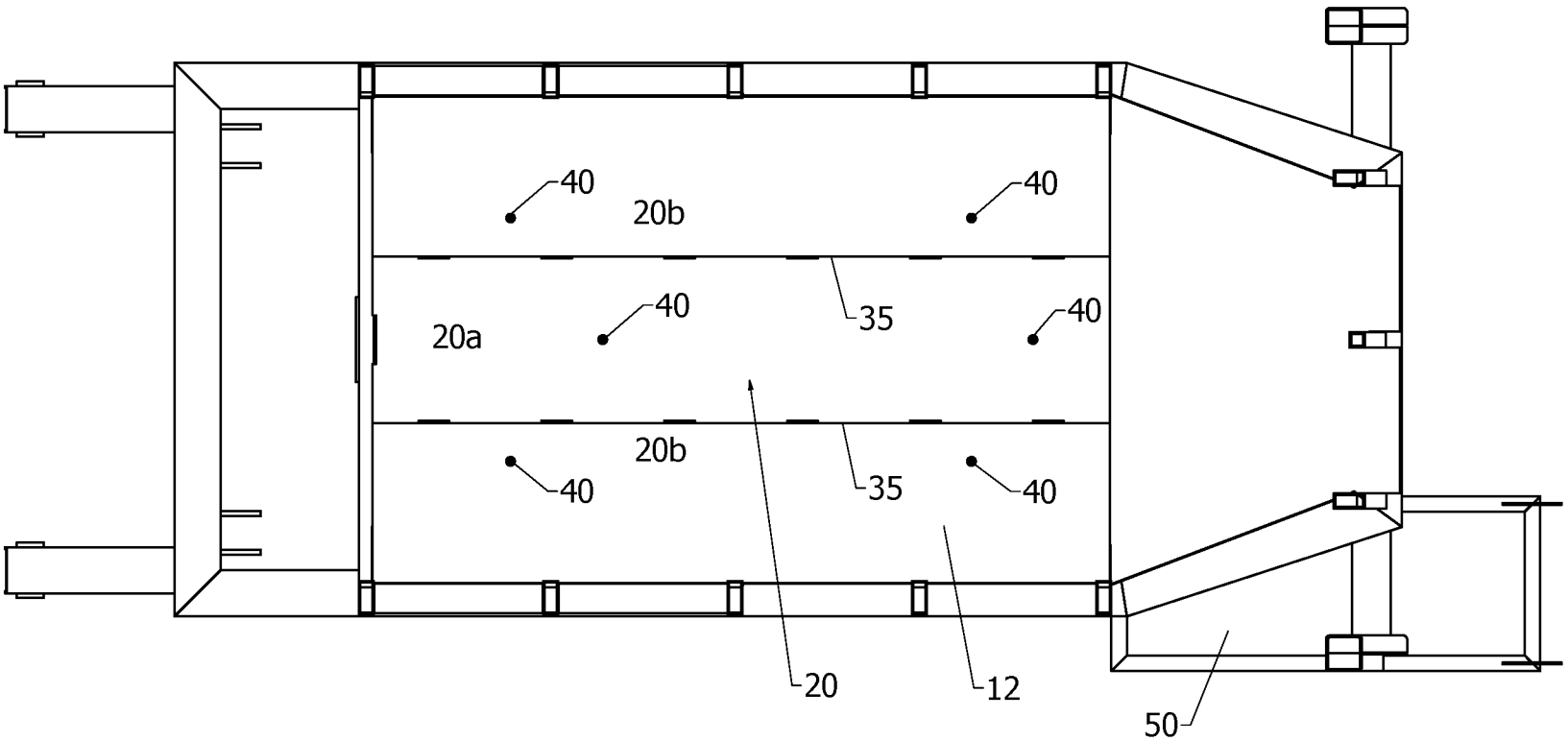
FIG. 8 is a top plan view of the asphalt carrier illustrated in FIG. 1.

The floor 20 may include a plurality or web of thermocouples spaced apart in an array throughout the floor 20. For example, in one embodiment of the present disclosure as shown in FIG. 8, the plurality of thermocouples may include six thermocouples. For example, two thermocouples 40, 40 may be spaced apart along the central portion of the floor 20*a*, and a pair of thermocouples 40, 40 may be similarly positioned spaced apart on each of the two peripheral portions of the floor 20*b*, 20*b*. Furthermore, the thermocouples on the central portion of the floor 28 may be laterally offset from the thermocouples located on each of the two peripheral portions 20*b*, 20*b* of the floor 20. As the thermocouples 40 are in direct contact with the volume of asphalt A, temperature readings recorded by the thermocouples 40 are an approximate measurement of the temperature of the volume of asphalt. In one embodiment, the measurements of the thermocouples 40 may be averaged so as to determine the average temperature of the asphalt material A which may facilitate a more accurate reading of the temperature of the asphalt material A. Signals from the thermocouples 40 may be used by a controller to control heater assembly 33, for example by firing the heater assembly 33 whenever required so as to maintain the asphalt A within an optimum temperature range. However, it will be appreciated by person skilled in the art that there may be other ways of measuring the temperature of the asphalt material and that such methods and mechanisms are intended to be included in the scope of the present disclosure.

Some embodiments of the present disclosure may optionally include a tar tank 50 which may be adjacent to the asphalt hopper 12, such as shown in FIG. 8. As may be viewed in FIG. 9, the tar tank 50 may be heated by a separate tar heating assembly, such as for example a burner 51 and burner tube 52, the tank 50 including a pipe 53 leading to a dispensing outlet 54 for dispensing heated tar from tar tank 50. Advantageously, by having a separate heating or burner assembly 51, 52 for the tar tank, the temperature of the tar tank 50 may be controlled separately from the temperature of the asphalt hopper 12.

For example, in some embodiments the tar tank may include at least one thermocouple extending into the tar tank 50 for monitoring the temperature of the volume of tar within the tank 50. In other embodiments, the tar tank 50 may include a pair of elongated thermocouples 59*a* and 59*b* extending from an upper end 48 of tar tank 50 into the tar tank. Thermocouple 59*b* may be located proximate to the tar pipe 53 and tar dispensing outlet 54 and may terminate approximately one inch above the floor 55 of the tar tank, such that when the front portion of frame 9 is lifted to dispense asphalt from the asphalt hopper, the thermocouple 59*b* remains in contact with the liquid tar even if the volume of tar within tar tank 50 is low. Advantageously, such a positioning of thermocouple 59*b* so as to substantially remain in contact with the volume of tar within tank 50 even when the front portion of the frame 9 has been lifted assists with ensuring constant monitoring of the temperature of the volume of tar. Furthermore, a second thermocouple 59*a* may be located proximate to thermocouple 59*b* and farther from the tar dispensing outlet 54 relative to the first thermocouple 59*b*, and the second thermocouple 59*a* may be shorter than thermocouple 59*b*, for example terminating approximately six inches above the floor 55 of the tar tank, thereby monitoring the temperature of the volume of tar at a different location within the volume of tar, as compared to the first thermocouple 59*b*. The temperature measurement signals emitted by thermocouples 59*a*, 59*b* may be paralleled so as to obtain an average temperature of the tar within tank 50, such that when the signals are sent to the signal temperature the average temperature of the tar within the tank is utilized by the controller to control the tar heating assembly, thereby allowing for more accurate control of the tar temperature without, for example, causing the tar to become overheated. Although an example of the positioning of the thermocouples 59*a*, 59*b* within tar tank 50 is described herein, it will be appreciated by a person skilled in the art that the present disclosure is not limited to the specific embodiments described herein and that other designs of the optional tar tank 50, which may include fewer or more thermocouples, mounted in different positions within the tar tank, are also intended to be included in the scope of the present disclosure.

Figure 9:
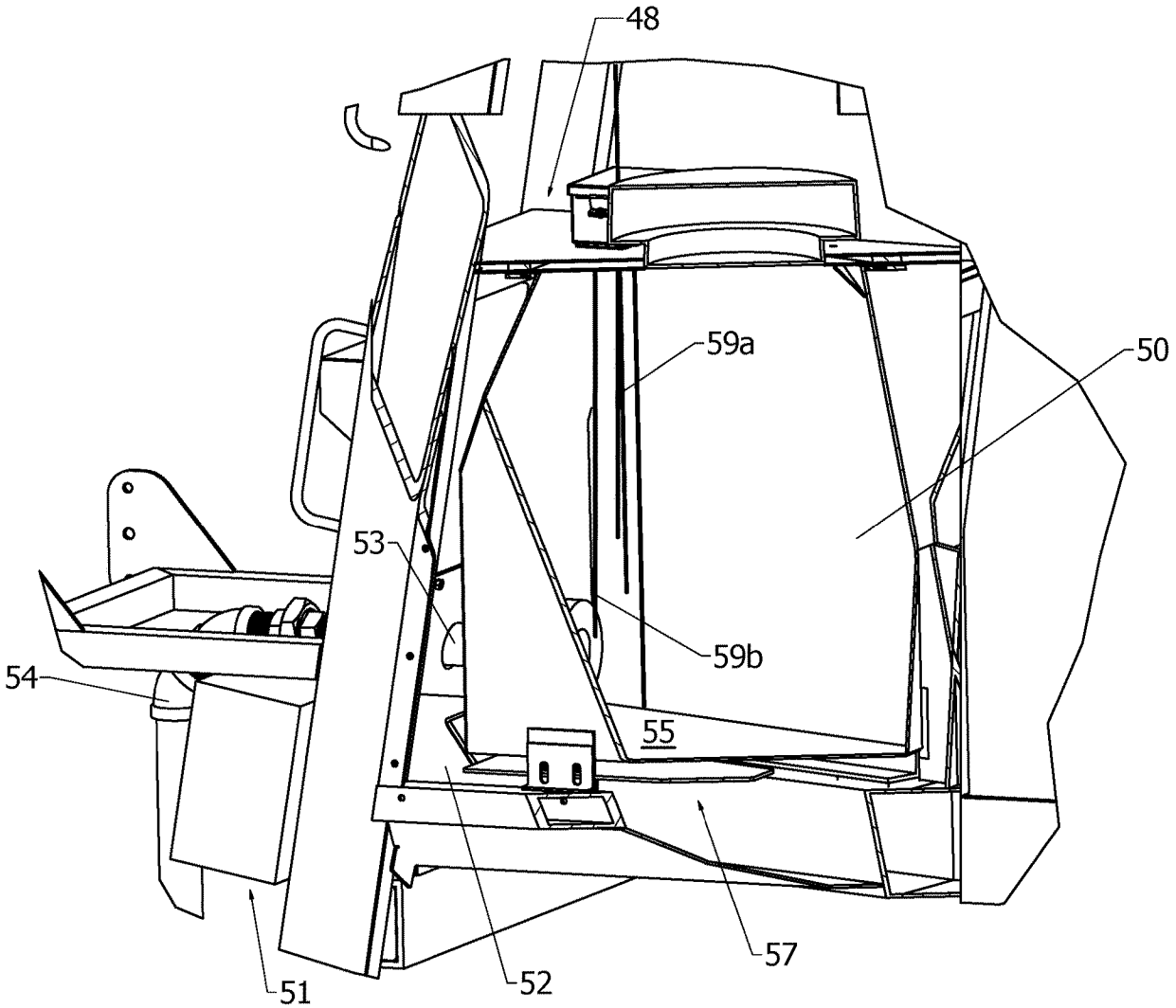
FIG. 9 is a sectional view of the tar tank of the asphalt carrier shown in FIG. 2.
Figure 10:
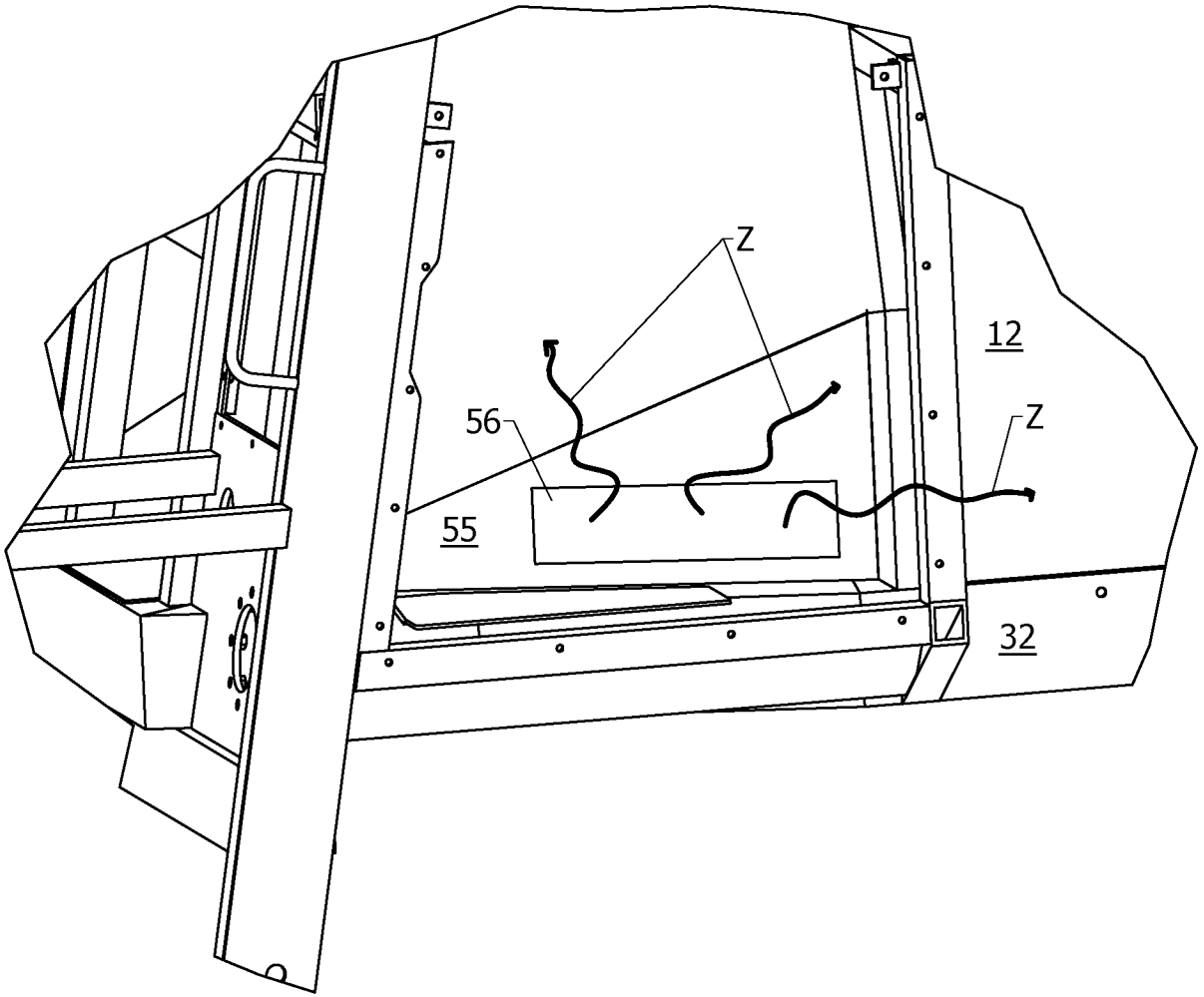
FIG. 10 is an isometric view of the tar tank shown in FIG. 9.
Figure 11:
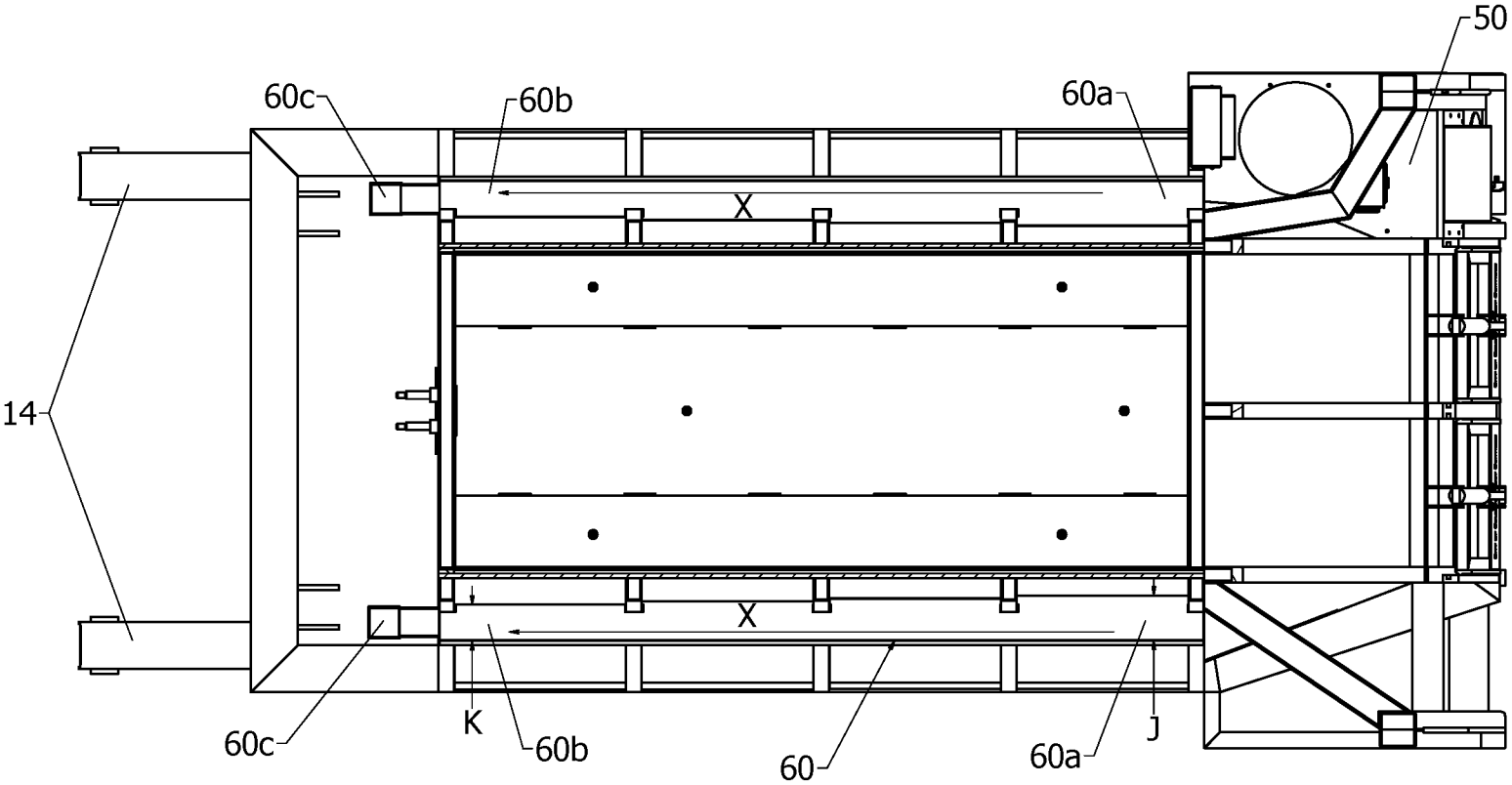
FIG. 11 is a top plan view of the carrier shown in FIG. 2, with the hopper doors removed.
Figure 12:
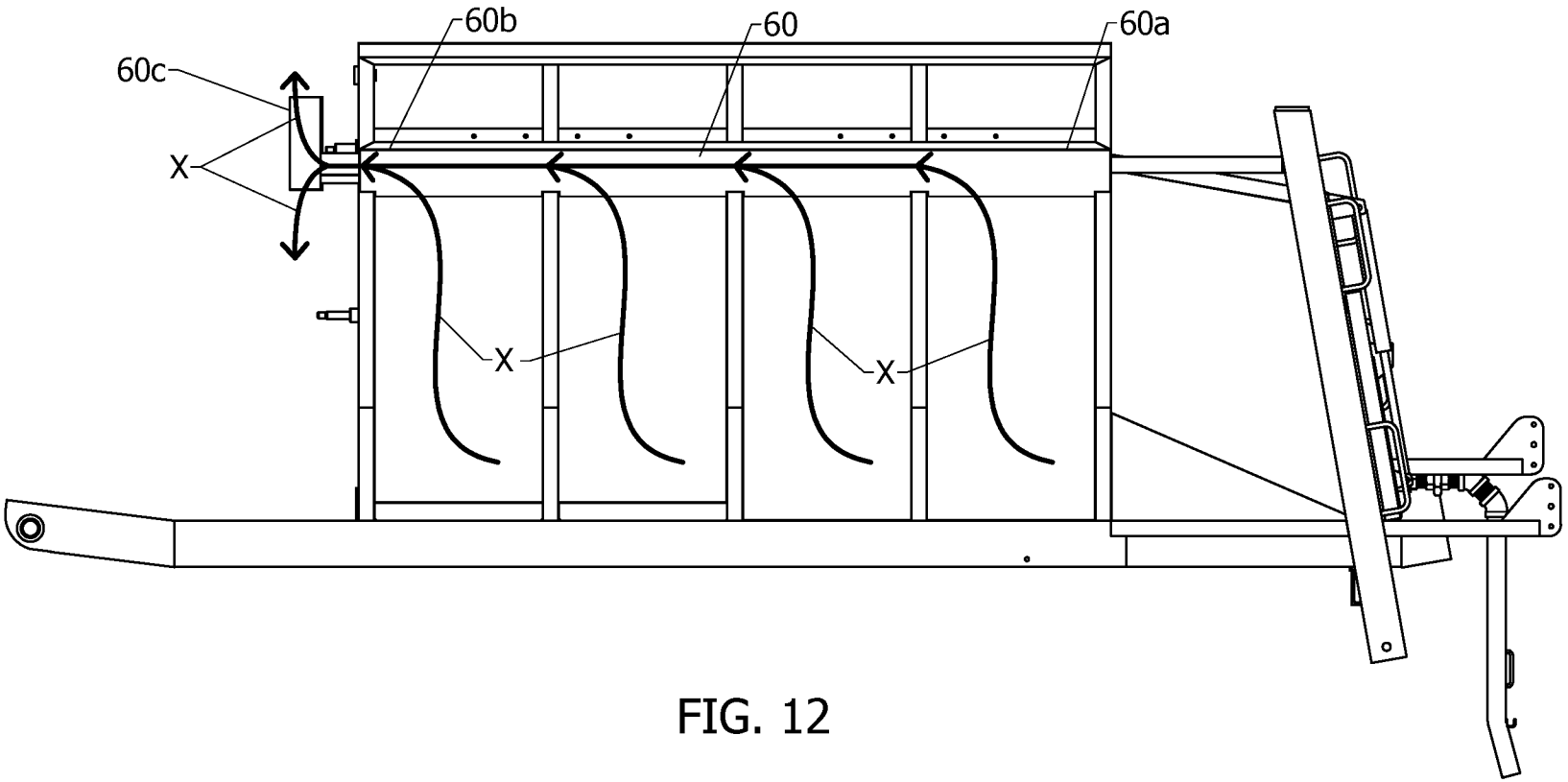
FIG. 12 is a side elevation view of the carrier shown in FIG. 11, showing the pathways of the heated gas travelling through the exhaust collector.

Further advantageously, in some aspects of the present disclosure the heat exchange system of the tar tank 50 may be in selective fluid communication with the heat exchange system of the asphalt hopper 12. For example, as best seen in FIGS. 9 and 10, the side wall extension 58 of the heating chamber 32 may be provided with a damper 56 which enables heated gas, denoted by arrows Z, to flow through the damper 56 and into the heating chamber 32 of the asphalt hopper 12. The damper may be arranged such that the tar burner chamber is only separated from the asphalt heating chamber 32 when the tar tank burner assembly 51, 52 is not in use. When the asphalt chamber 32 is in use, the exhaust Z of the tar tank heating chamber 57 flows into the heating chamber 32 of the asphalt hopper 12. Advantageously, this results in providing additional heat to the asphalt heating chamber 32 rather than exhausting the heated gases Z of the tar tank heating chamber 57 into the atmosphere. This arrangement thereby further adds to the efficiency of the overall system, in embodiments of the asphalt carrier 10 which include a separate tar tank 50.

Advantageously, in some embodiments of the present disclosure, the Applicant has found that the asphalt carrier may be capable of recycling used asphalt without the use of agitators. While asphalt recyclers are generally known in the prior art, such recyclers typically utilize one or more agitators so as to facilitate the breaking up of chunks of used asphalt into smaller pieces. However, portable asphalt carriers in accordance with the present disclosure may be so efficient as to not require any agitators to accomplish fully recycling a load of used asphalt, the used asphalt comprising, for example without intending to be limiting, chunks in the range of approximately 1-3 $dm^3$. In the applicant's experience, for example, loads of used asphalt of up to 4 metric tonnes may be recycled in an asphalt carrier with a total capacity of 8 metric tonnes which is constructed in accordance with the present disclosure. In some embodiments, the Applicant may load the asphalt carrier with used asphalt, add solvents or recycling additives, as are known in the art, and set the asphalt hopper to maintain the heat within a temperature range of substantially 320° F.-350° F. (160° C.-177° C.). Approximately 12 hours later, the load of used asphalt is heated and ready for use. An example of the solvents or recycling additives, without intending to be limiting, includes the asphalt rejuvenation agent marketed under the brand name Reclamite™.

In other aspects of the present disclosure, other design considerations for the design of the asphalt carrier 10, for embodiments which may be releasably mounted to the box of a truck, include that the asphalt carrier when mounted to the truck should preferably conform with road vehicle load ratings in accordance with the jurisdiction in which the asphalt carrier is being used, so as to enable the truck having the mounted asphalt carrier to travel on roads within that jurisdiction. For example, in some embodiments, when the carrier 10 is mounted to a truck box of a truck and the volume of a full load of asphalt is substantially equal to eight metric tonnes, an overall weight of the truck is less than 24,000 kg, an overall height of the truck measured from the ground beneath the truck to the uppermost height of the asphalt hopper 12 is less than 4.15 meters, an overall width of the truck is less than 2.6 meters and an overall length of the truck measured from the front of the truck to the rear portion 15 of the hopper 12 is less than 12.5 meters.

What is claimed is:

1. A portable asphalt heater apparatus for heating a volume of asphalt, the apparatus comprising:

an asphalt hopper having a floor, first and second side walls and front and rear end walls, the side walls and end walls extending upwardly from the floor and defining an upper opening into the hopper, the upper opening positioned above the floor and having an opening area which is less than a surface area of the floor, the first and second side walls including an inwardly extending portion tapering inwardly and extending between the floor and the upper opening, so as to define a substantially inverted V geometry when viewed in a vertical cross-section of the hopper taken generally parallel to and between the front and rear end walls of the hopper, at least one door selectively closing the upper opening, an asphalt heating manifold including an asphalt heating chamber adjacent to and positioned beneath the floor, the asphalt heating manifold in fluid communication with an asphalt heater assembly, the asphalt heating manifold adapted to direct a heated gas emitted from the asphalt heater assembly through the asphalt heating chamber and asphalt heating manifold, wherein the volume of asphalt when in the asphalt hopper is heated through contact with the asphalt hopper, and wherein the apparatus is adapted for mounting on a vehicle.

2. The apparatus of claim 1 wherein the asphalt heating manifold further comprises a plurality of chimneys, the plurality of chimneys in fluid communication with and extending from the asphalt heating chamber and along the first and second side walls.

3. The apparatus of claim 2 wherein the asphalt heating manifold further comprises an exhaust collector in fluid communication with the plurality of chimneys and located adjacent to the upper opening of the hopper.

4. The apparatus of claim 1 wherein the at least one door includes two doors, each door of the two doors pivotally mounted to the first and second side walls, whereby each door of the two doors pivots towards and away from the other door.

5. The apparatus of claim 4 wherein the apparatus is adapted to be mounted in a truck box, each door of the two doors pivotable between a closed position and an open position, each door of the two doors having a distal end distal from the opening of the hopper, wherein when in the open position a distance between the distal ends of the two doors is greater than a width of the truck box.

6. The apparatus of claim 1 further comprising a tar tank positioned adjacent to the rear end wall of the asphalt hopper, the tar tank including a tar heater assembly and a tar heating manifold.

7. The apparatus of claim 6 wherein the tar heating manifold includes one or more exhaust ducts selectively in fluid communication with the asphalt heating manifold.

8. The apparatus of claim 6 wherein the heater assembly and the tar heater assembly each include a burner and a burn tube.

9. The apparatus of claim 2 wherein the asphalt heating chamber is divided into a central chamber and two peripheral chambers, wherein the central chamber and two peripheral chambers each extend substantially between the front and rear end walls, each chamber of the two peripheral chambers being adjacent the first or second side walls and the central chamber positioned between and adjacent to the two peripheral chambers, wherein the heated gas emitted from the asphalt heater assembly flows through the central chamber and then through the two peripheral chambers.

10. The apparatus of claim 9 wherein the floor includes a central portion adjacent to and above the central chamber and two peripheral portions adjacent to and above the two peripheral chambers, wherein the central portion has a thickness that is greater than a thickness of each peripheral portion of the two peripheral portions wherein coking of the portion of the volume of asphalt positioned directly above the asphalt heater assembly beneath the floor of the hopper is minimized.

11. The apparatus of claim 10 wherein each chimney of the plurality of chimneys is in fluid communication with each peripheral chamber of the heating chamber and wherein each chimney of the plurality of chimneys extends from the peripheral chamber and along a surface of the first or second side wall towards the upper opening of the hopper.

12. The apparatus of claim 1 wherein the apparatus is configured to be a slide-in apparatus to releasably mount to the vehicle.

13. The apparatus of claim 12 wherein the vehicle is a truck including a truck box and the slide-in apparatus is configured to releasably mount to the truck box.

14. The apparatus of claim 13 wherein when the apparatus is mounted to the truck box and the volume of asphalt is substantially equal to eight metric tonnes, an overall weight of the truck is less than 24,000 kg, a height of the truck is less than 4.15 meters, an overall width of the truck is less than 2.6 meters and an overall length of the truck is less than 12.5 meters.

15. The apparatus of claim 1 wherein the floor further includes a plurality of thermocouples for monitoring a temperature of the volume of asphalt.

16. The apparatus of claim 15 wherein the plurality of thermocouples includes six thermocouples, each thermocouple of the six thermocouples spaced apart from the other thermocouples.

17. The apparatus of claim 10 wherein the floor further includes at least six thermocouples, wherein two thermocouples of the at least six thermocouples are located spaced apart on the central portion of the floor and two thermocouples of the at least six thermocouples are located spaced apart on each peripheral portion of the two peripheral portions of the floor.

18. The apparatus of claim 8 wherein the tar tank includes a plurality of thermocouples for monitoring a temperature of a volume of tar within the tar tank.

19. The apparatus of claim 18 wherein the plurality of thermocouples includes at least two elongate thermocouples extending into the tar tank.

20. The apparatus of claim 1 wherein the first and second side walls include a first portion below the inwardly extending portion, the first portion selected from the group comprising: vertical portion, outwardly extending portion.

21. The apparatus of claim 20 wherein the first portion extends from the floor to the inwardly extending portion, and wherein the inwardly extending portion extends inwardly from the first portion at an angle of substantially 30 degrees from the vertical, the hopper having a height extending substantially from the floor to the upper opening of the hopper, wherein a junction between the first and inwardly extending portions of the first and second side walls is located at substantially 20% of the height of the hopper measured from the floor of the hopper.

22. The apparatus of claim 21 wherein the first portion is the outwardly extending portion, the outwardly extending portion extending from the floor to the junction at an angle of substantially 45 degrees from the vertical.

23. A method for heating and recycling a volume of used asphalt using a portable asphalt heater apparatus, the method comprising:

loading the volume of used asphalt into a hopper of the portable asphalt heater adapted for mounting on a vehicle, the hopper comprising a floor, first and second side walls and front and rear end walls, the side walls and end walls extending upwardly from the floor and defining an upper opening into the hopper, the upper opening positioned above the floor and having an opening area which is less than a surface area of the floor, the first and second side walls including an inwardly extending portion tapering inwardly and extending between the floor and the upper opening, so as to define a substantially inverted V geometry when viewed in a vertical cross-section of the hopper taken generally parallel to and between the front and rear end walls of the hopper, the hopper further including at least one door for selectively closing the upper opening, the portable asphalt heater further including an asphalt heating manifold including a heating chamber adjacent to and positioned beneath the floor, the asphalt heating manifold in fluid communication with a heater assembly, the asphalt heating manifold adapted to direct a heated gas emitted from the heater assembly through the heating chamber and the asphalt heating manifold, loading one or more recycling additives into the hopper, setting the heater assembly of the portable asphalt heater to maintain the volume of used asphalt at a recycling temperature.

24. The method of claim 23 further comprising the steps of removing the volume of used asphalt from the hopper after a selected time interval has lapsed and applying the volume of used asphalt to a surface.

25. The method of claim 24 wherein the method further comprises the steps of mounting the portable asphalt heater to the vehicle and transporting the portable asphalt heater to the surface.

* * * * *